US006360443B1

(12) United States Patent
Remus

(10) Patent No.: US 6,360,443 B1
(45) Date of Patent: Mar. 26, 2002

(54) FOLDING KNIFE WITH BLADE ACTUATING MECHANISM

(76) Inventor: Cesar Remus, Apt. 2A, Circe St., Alto Apolo Tower, Guaynabo, PR (US) 00969

( * ) Notice: Subject to any disclaimer, the term of this patent is extended or adjusted under 35 U.S.C. 154(b) by 0 days.

(21) Appl. No.: 09/656,587

(22) Filed: Sep. 6, 2000

(51) Int. Cl.[7] ..... B26B 1/02
(52) U.S. Cl. ..... 30/158; 30/160
(58) Field of Search ..... 30/158, 155, 160, 30/161

(56) References Cited

U.S. PATENT DOCUMENTS

| | | | | |
|---|---|---|---|---|
| 2,416,277 A | | 2/1947 | Siegel | 30/158 |
| 4,095,337 A | | 6/1978 | Pharr | 30/158 |
| 4,120,088 A | | 10/1978 | Phelps | 30/160 |
| 4,354,313 A | | 10/1982 | Naideh | 30/161 |
| 4,451,982 A | | 6/1984 | Collins | 30/161 |
| 4,612,706 A | * | 9/1986 | Yunes | 30/160 |
| 4,713,885 A | * | 12/1987 | Keklak et al. | 30/162 |
| 4,719,700 A | | 1/1988 | Taylor, Jr. | 30/158 |
| 5,009,008 A | | 4/1991 | Yablonovitch | 30/158 |
| 5,331,741 A | | 7/1994 | Taylor, Jr. | 30/158 |
| 5,495,674 A | | 3/1996 | Taylor, Jr. | 30/160 |
| 5,502,895 A | | 4/1996 | Lemaire | 30/158 |
| 5,511,311 A | | 4/1996 | Collins | 30/162 |
| 5,522,138 A | | 6/1996 | Betts, Jr. | 30/160 |
| 5,815,927 A | | 10/1998 | Collins | 30/161 |
| 5,896,665 A | | 4/1999 | Harris | 30/160 |
| 6,044,562 A | | 4/2000 | Dillenbeck | 30/162 |

* cited by examiner

*Primary Examiner*—Hwei-Slu Payer
(74) *Attorney, Agent, or Firm*—Liebler Ivey & Connor; Floyd E. Ivey

(57) ABSTRACT

A folding blade knife which may comprise a handle member, and including at least one upper handle member and at least one lower handle member defining a channel. The knife may further include a blade member pivotally mounted, via a pivotal member, to the handle member and within the channel. An actuator may be slidably mounted to the at least one upper handle member and joined to the blade member back end, for actuation by a user, such that when the user exerts a force against the actuator to slide the actuator with respect to the handle member, the user-exerted force is transmitted to the blade member back end to rotate the blade member. A pin slot may be formed within the at least one handle member at the handle member front end and arched around the pivotal member. An actuator slot may be formed within the at least one upper handle member at the handle member front end, having a linear portion and an arc portion. At least one link member may be slidably mounted within the actuator slot by pin and bushing mechanisms. At least one elongated member may be rotatably joined to the at least one link member and further to a member affixed to the blade member and extending through the pin slot. A switch member may be affixed to the at least one link member to thereby facilitate the exertion of force against the actuator to slide the actuator with respect to the handle member to thereby open or close the blade member. The folding blade knife may further comprise a combination lock member to lock the blade member upon closing as the switch member is pulled towards the handle member back end.

22 Claims, 13 Drawing Sheets

FOLDING KNIFE WITH BLADE ACTUATING MECHANISM

FIELD OF THE INVENTION

The present invention relates generally to folding knives and in particular to a folding knife having means for actuating one or more knife blades from a closed position to an open position and the reverse.

BACKGROUND OF THE INVENTION

The typical folding knife has a handle member and one or more blades, pivotally mounted within a channel in the handle member. The typical folding knife may have a liner member or liner members juxtaposed the one or more blades. To prevent accidental opening of the knife, each blade may be biased in the closed position by a mechanism such as a spring or detent. To open the blade, the user may insert a thumbnail of one hand into a notch or groove near the back edge of the blade, and manually rotate the blade around its pivot point while holding the handle member. Some folding knives may employ a thumb stud or hole on the blade to facilitate opening the blade with one hand.

There are a number of folding knives with various mechanisms for opening the knife blade. However, none of them open the knife blade as contemplated by the present invention. Typically, these knives utilize wheel or gear mechanisms that rotate the blade upon actuation by a user. U.S. Pat. No. 2,416,277 to S. Siegel discloses a pocket knife having a rack mounted to the blade to rotate the blade when an externally extending portion of an operating member is pulled. U.S. Pat. No. 4,719,700 to Taylor, Jr. discloses a knife having a concentric wheel. When the user exerts a force to slide the actuator, the user-exerted force is transmitted by the non-extensible linkage to rotate the wheel, thereby pivoting the blade from its closed position to its open position. U.S. Pat. No. 5,331,741 to Taylor, Jr. discloses a knife having a knife with a thumb-actuated lever having an opening lever driving a sector gear that engages a drive gear for opening the knife blade. U.S. Pat. No. 5,495,674 to Taylor, Jr. discloses a knife having a user actuated button slidably mounted to a casing. The button is disposed on the end of an elongated shaft which extends through a spring, pawl, casing, and a blade.

SUMMARY OF THE INVENTION

The present invention comprises a folding knife having a mechanism to allow the user to open and close the blade with one hand. The folding knife depicted has a blade opening mechanism that allows for user control over the blade during opening and closing with the blade opening mechanism operating in a smooth fashion. The blade opening mechanism, the blade actuator, does not rely on momentum to move or rotate the blade.

The present invention discloses a folding blade knife which may comprise a handle member, having a handle member front end and a back end, and including at least one upper handle member and at least one lower handle member defining a channel. The knife may further include a blade member, having a blade member front end and a back end, said blade member back end may be pivotally mounted to said handle member front end and within the channel. The blade member may have a closed position and an open position with respect to the handle member. The knife may further include a pivotal mounting means formed, in the preferred embodiment, of a pivotal member pivotally mounting said blade member back end proximal to said handle member front end.

An actuator means or system is utilized to transmit rotational motion to the blade. The actuator means or system may be composed, for example, of a switch slidably mounted to a handle member, and as depicted herein for convenience in illustration, to at least one upper handle member and joined to the blade member back end, for actuation by a user, such that when the user exerts a force against the switch to slide said actuator with respect to the handle member, the user-exerted force is transmitted to the blade member back end to rotate the blade member. It will be apparent to those of ordinary skill in the art that an actuator means or system switch or handle may be positioned on an upper or lower handle member.

In the preferred embodiment, the actuator means or system comprises generally a slidable switch interconnected with a linking mechanism affixed to the blade member such as to exert rotational force on the blade member. In this invention, the actuator means or system may comprise at least one link member slidably mounted within an actuator slot by, but not limited to, pin and bushing mechanisms. The actuator slot is, in the preferred embodiment, positioned in a liner and, as depicted herein, within an upper liner member. The actuator means may further comprise at least one elongated member, having an elongated member front end and a back end, where the elongated member back end may be rotatably joined to the at least one link member via pin and bushing mechanism. Pin and bushing mechanisms referred to here include generally means of interconnecting bushing or bearing means to a link member and within a slot; in this instance a pin and bushing interconnects a link member and a slot, denominated herein as a actuator slot, and additionally, a link member to an elongated member with both the link member and the elongated member interconnected to an actuator slot. Additionally, depicted herein at the pin and bushing joining the link member to the actuator slot is a switch link pin.

In the preferred embodiment, the actuator means or system exerts rotational force on the blade member by joinder of the least one elongated member front end to the blade member proximal the blade member back end. The joining mechanism or means depicted herein is a blade pin member protruding from the blade member proximal the blade member back end. The blade pin member may be affixed by affixing means including forging, welding, screw, thread and other affixing means, to the blade member back end and extend through the pin slot, such that the blade pin member is received by the pin slot and is positioned proximal the pin slot back end when the blade member is in the closed position and the blade pin member is positioned proximal the pin slot front end when the blade member is in the open position. The blade pin member, when extended through the pin slot is affixed by affixing means proximal the elongated member front end and in the preferred embodiment the blade pin member is received into an aperture proximal the elongated member front end denominated herein as the elongated member aperture.

A switch, lever, or the like member, is slidable affixed at a handle member, and as shown in the preferred embodiment, an upper handle member at a switch slot. The switch may be affixed within a switch slot by means including, as depicted herein, as a switch slide formed generally of a flat element, affixed to the switch, of a dimension greater than that of the width of the switch slot; the switch is further affixed to linking means comprised for example of at least one switch link pin to thereby facilitate the exertion of slidable force against the link member to slide the link member and elongated member with respect to the handle member, actuator slot and pin slot. The switch may be interconnected to the link member by a switch link pin or equivalent interconnection means. The preferred embodiment depicts a pin denominated here as the switch link pin, at the pin and bushing mechanism interconnecting the link member with the actuator slot; the switch link pin is received by a link member aperture and a switch pin aperture thereby illustrating one means of interconnecting a switch with a link member.

The folding blade knife may farther comprise a pin slot, formed within a handle member or the at least one upper or lower handle member or the at least one upper or lower liner member or a combination of the at least one upper or lower handle member and the at least one upper or lower liner member, proximal the handle member front end, upper or lower handle member front end or upper or lower liner member front end and arched around the pivotal member. The pin slot may have a pin slot front end and a back end. In the preferred embodiment, the pin slot may define an arc, composed of a half-circle arc in the preferred embodiment, with respect to the pivotal member, the pivotal member defining a circle center relative to the half-circle arc. The pin slot back end, the pin slot front end, and the pivotal member may be configured in a substantially linear arrangement thereby defining a diameter from the pin slot back end, pin slot front end, and through the pivotal member. Preferably, the substantially linear arrangement of the pin slot back end, the pin slot front end, and the pivotal member is substantially at a forty-five degree angle with respect to normal.

In the preferred embodiment, the knife may further comprise an actuator slot, formed within a handle member, the at least one upper or lower handle member or the at least upper or lower liner member, having a linear portion and an arc potion. The actuator slot performing the function of guiding the pin and bushing mechanisms interconnecting the link member and switch and the link member and elongated member as force is exerted by the switch to provide rotational force to the blade member. The actuator slot in the preferred embodiment having a linear portion front end and a back end, and an arc portion having an arc portion front end and a back end. The actuator slot arc portion may be positioned proximal the handle member front end between the pin slot and the pivotal member with said actuator slot linear portion extending a distance distal from the actuator slot arc portion back end. The actuator slot linear portion may extend in a substantially horizontal direction in the same horizontal plane as the pivotal member.

To operate, a user may hold the knife in one hand. The user's thumb may push the switch, lever, or actuator forward towards the handle member front end and thereby exerting force on switch link pin and hence the elongated member with their respective pin and bushing mechanisms causing the blade pin member to travel in the pin slot from pin slot back end toward pin slot front end thereby rotatably moving the blade member from the closed position toward the open position. The user's thumb may pull the switch, lever, actuator, or like member towards the handle member back end and thereby move the blade member towards the close position.

The folding blade knife may further comprise means, joined to the actuator, to lock the blade member in the closed position. The locking means may include, but is not limited to, a combination lock member, having a shaft, affixed to the actuator. In one embodiment, the combination lock member may lock the blade member upon closing as the switch, lever, or like member is pulled towards the handle member back end. In other embodiments, the user may be required to turn dials, buttons or the like on the combination lock member to thereby lock the blade member in the closed position.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
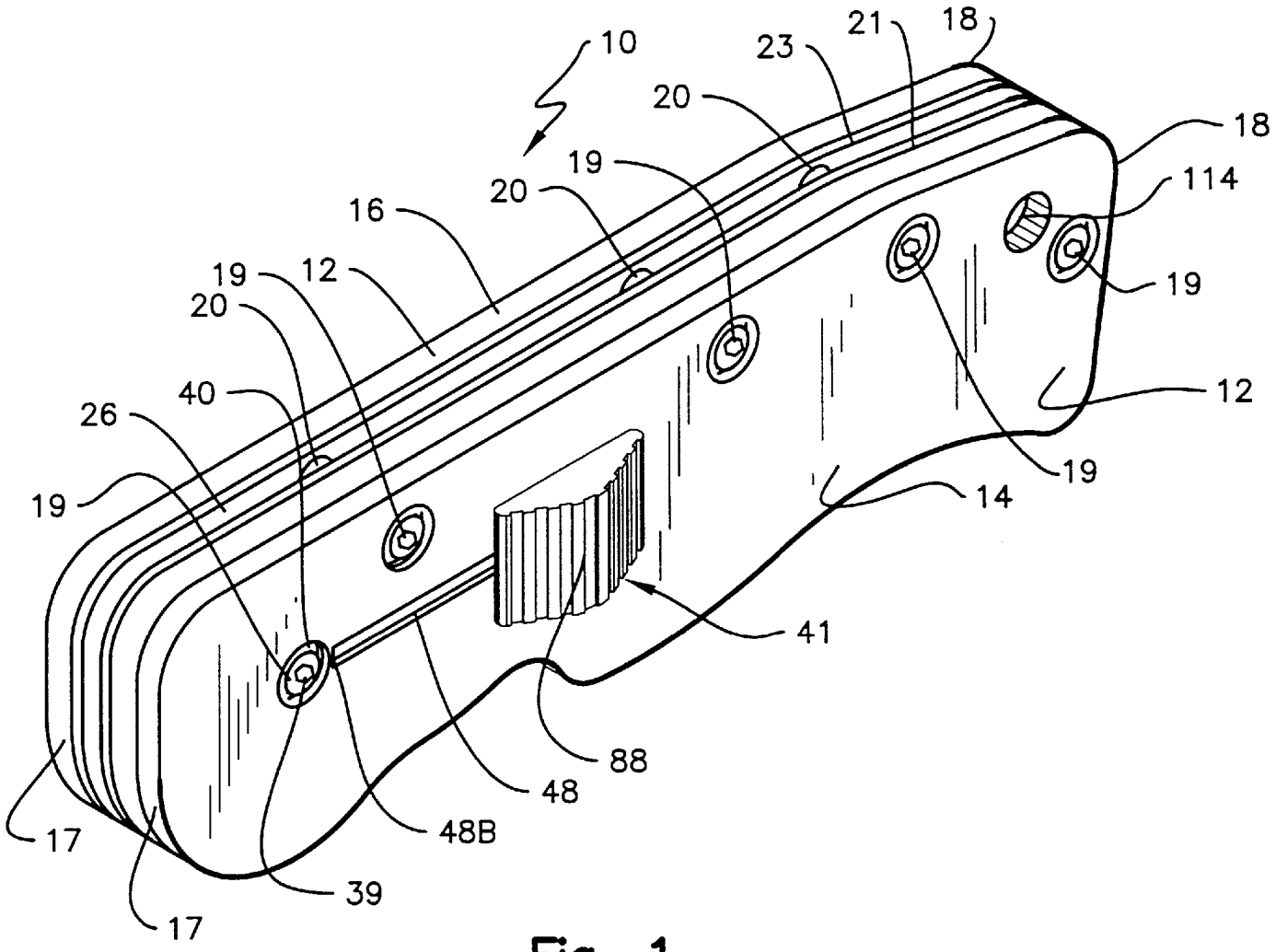
FIG. 1 is a perspective view of a front elevation of a folding knife with the blade member in the closed position.
Figure 2:
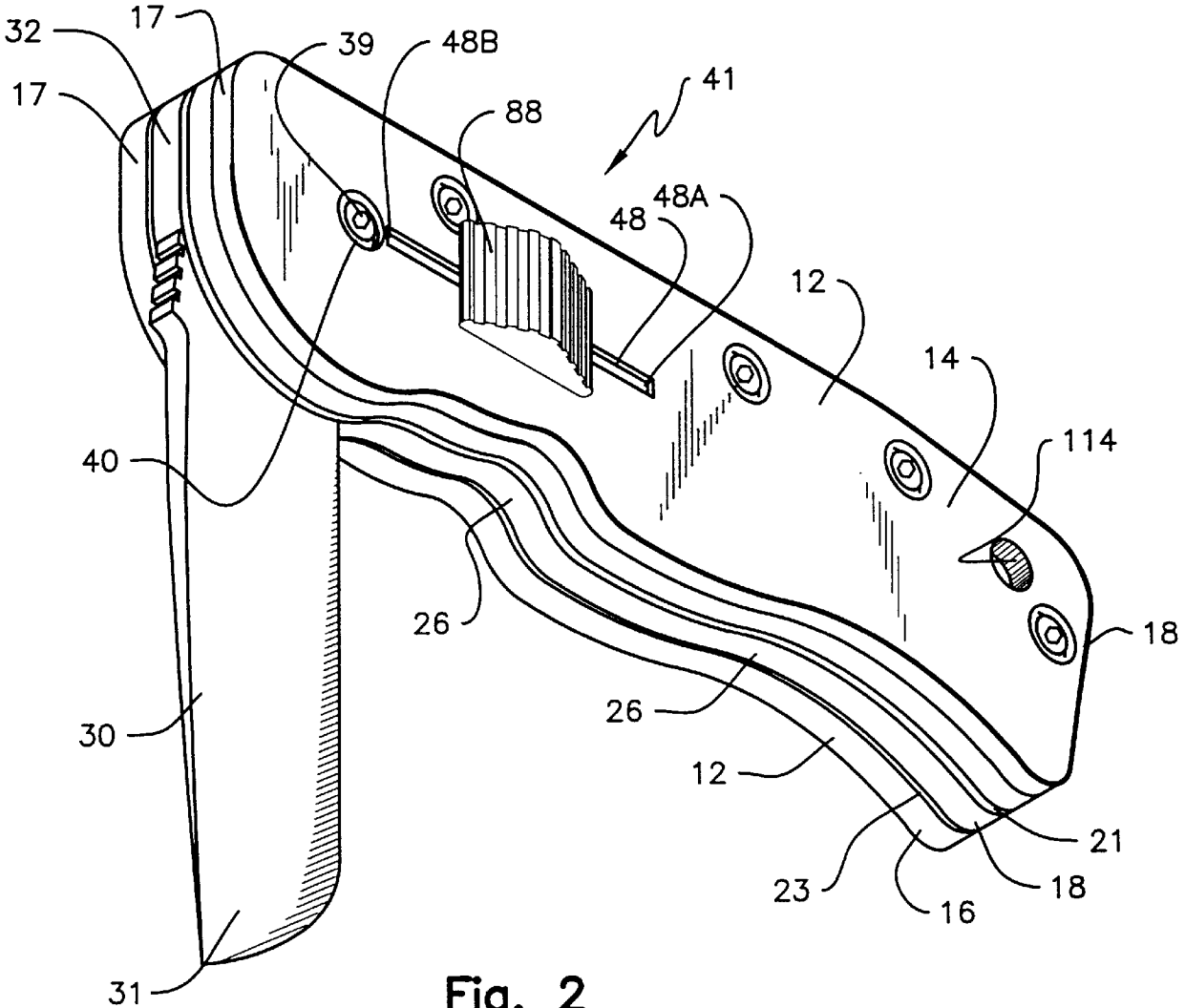
FIG. 2 is a perspective view of a knife constructed in accordance with the present invention where the blade member is partially opened.

The preferred embodiment(s) are depicted in FIGS. 1 through 8 wherein the invention discloses a folding blade knife 10 which may comprise a handle member 12, having a handle member front end and a back end 17, 18, and including, in the preferred embodiment, at least one upper handle member 14 and at least one lower handle member 16 where, as shown in FIG. 2, the juxtaposition of the at least one upper and one lower handle members 14, 16 define a channel 26. The handle member 12 may be formed as a single piece or structure having therein a channel 26 to receive a blade member 30. Spacing and securing means will position the at least one upper and lower handle members 14, 16 to form the channel 26 including but not limited to spacers 20 separating the at least one upper and lower handle members 14, 16. The securing means may be generally comprised of machine screw female portion combined with a male thread portion from the at least one upper to lower handle member 14, 16. It will be recognized that such joining method or means may include rivets, brads and other such joining or affixing means. The knife 10 may further include a blade member 30, having a blade member front end and a back end 31, 32, said blade member back end 32 may be pivotally mounted proximal said handle member front end 17 and within the channel 26. The blade member 30 may have a closed position and an open position with respect to the handle member 12. The knife 10 may further include pivotal mounting means whereby to pivotally mount said blade member back end 32 proximal said handle member front end 17; pivotal mounting means may consist of a pin, named here pivotal member 39, fixed to and protruding from a handle member 12 proximal the handle member front end 17 where the pivotal member 39 is received through an aperture at the blade member 30 proximal the blade member back end 32; the aperture here denominated pivotal member aperture 40. The handle members 12 and upper and lower handle members 14, 16 may be formed of plastics, composite materials, metals, bone and other such materials. The blade member 30 will generally be formed of a metal capable of tempering but may be formed of steels, alloys, and other metals and substances, including for example ceramics and composites, recognized by those of ordinary skills in the knife arts as forming blade members.

Figure 4:
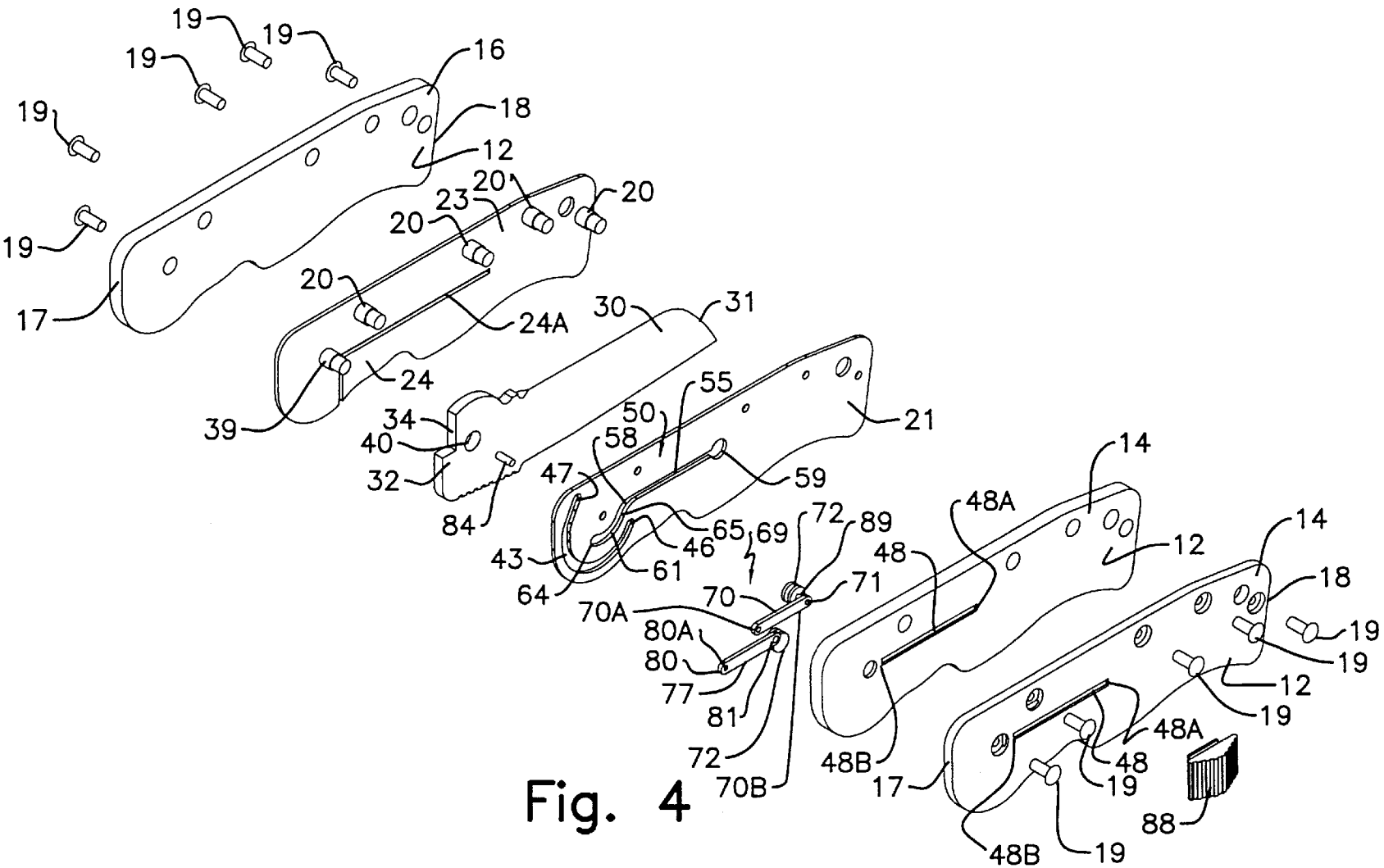
FIG. 4 is an exploded view of a knife constructed in accordance with the present invention illustrating handle members with handle member front and back ends, upper and lower handle members, upper and lower liner members, blade member with blade member front and back ends, blade pin member, blade member lock, pivotal member and pivotal member aperture, actuator system including; switch, switch slide, switch link pin, switch pin aperture, pin slot, pin slot back and front ends, actuator slot with linear portion and linear portion front and back ends and arc portion with arc portion front and back ends, link member with link member aperture and pin and bushing mechanisms and elongated member and elongated member front and back ends.
Figure 4A:
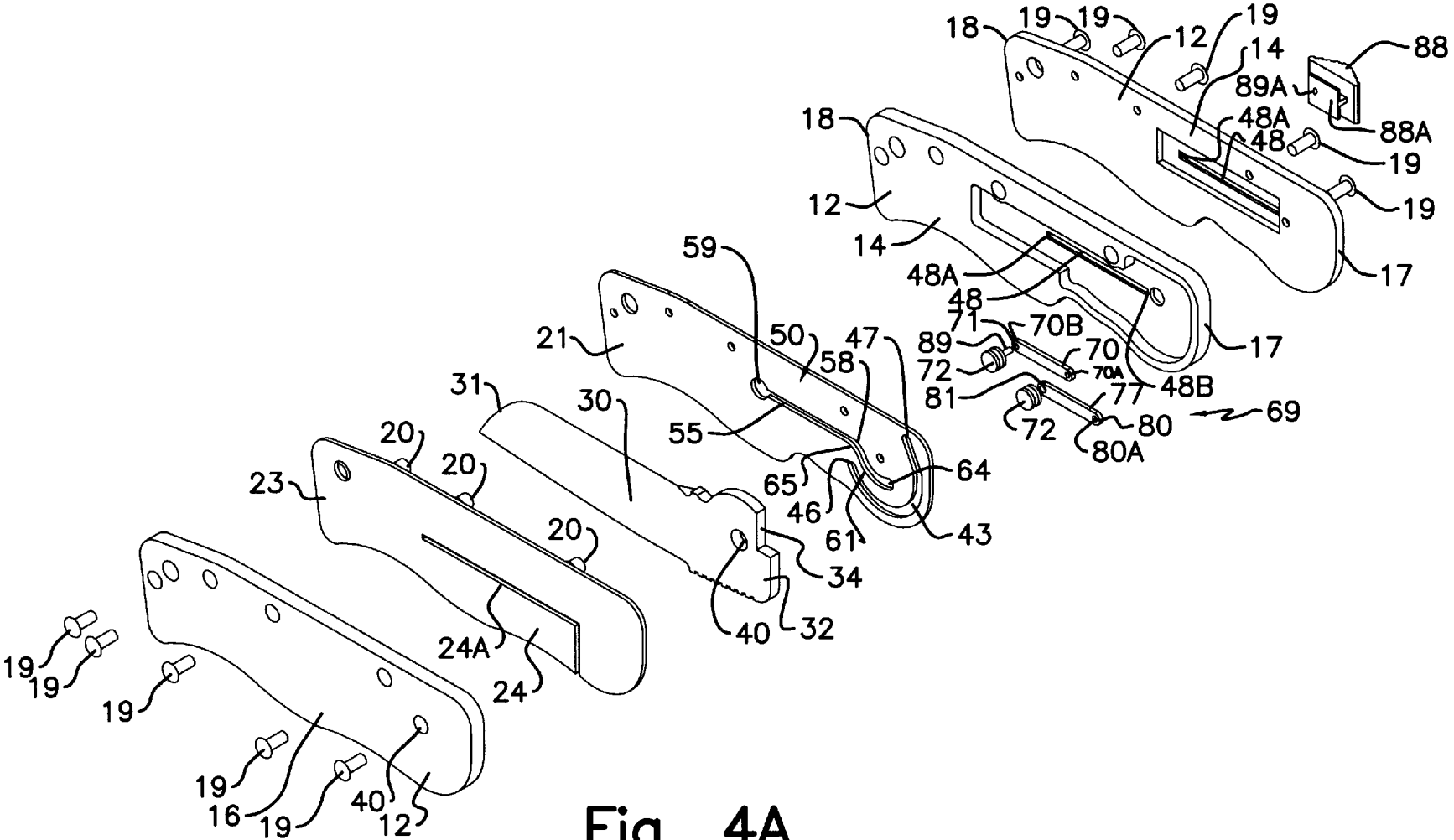
FIG. 4A is an exploded view of a knife constructed in accordance with the present invention.

FIG. 4 and 4A depict a blade member 30 open locking means composed of, in the preferred embodiment of at least one blade member lock 24 which has a spring function; blade member lock 24, in its spring function, is depressed when the blade member 30 is closed. The blade member lock 24 is released, when the blade member 30 is fully open; the blade member lock 24 in its released position locks the blade member 30 in its open position. For multiple blade member 30, 30A embodiments, there may be such a blade member 30 open locking means. The blade member lock 24, in the preferred embodiment is formed by a portion of a liner, and in this instance, of a lower liner member 23 or of the affixing of a elongated shaft or blade having a spring function with either positioned to be depressed by the blade member 30 when the blade member 30 is closed and which, when released upon opening of the blade member 30, moves by spring function or other equivalent action to physically block and thereby prevent the closing of the blade member 30; the blade member lock 24 is depressed to allow closing of the blade member 30. The suggested manner of forming the blade member lock 24, in the preferred embodiment, is by forming a slot in the lower liner member 23 seen in the preferred embodiment as blade member lock slot 24A. The material forming the lower liner member 23 is, in the preferred embodiment, titanium. However other materials may be utilized including metals, composite materials, plastics, and other materials. Where the blade member lock 24 is formed as demonstrated in FIG. 4, 4A, the material forming the lower liner member 23 will be capable of deformation and have memory allowing the blade member lock 24 to be displaced from a plane formed by the lower liner member 23 such that the blade member lock 24 moves to block the blade member 30 when the blade member 30 is opened. In this embodiment, the deformed blade member lock 24 will provide a spring function. It will be recognized that a member or element separate from the lower liner member 23 may be affixed to the lower liner member 23 which will substantially be positioned as is the blade member lock 24 as depicted in FIG. 4 and 4A. It will also be seen that a lower liner member 23 may not be utilized and that the blade member lock 24, or the element providing this lock function, may be affixed to a handle member 12 or provided by other lock means.

An actuator means or system 41 encompasses the linkage from a slidably movable switch 88 through a linking system 69 comprised, in the preferred embodiment of at least one link member 70 interconnected with at least one elongated member 77 by pin and bushing mechanisms 72 to permit transmission of force against the blade pin member 84 such that the blade member 30 may be rotated from closed to open and back to close position. The linking system 69 may in other embodiments be composed of at least one link with pin and bushing mechanisms 72 interconnecting the switch 88 with a blade pin member 84 such that rotational force may be exerted to rotate the blade member 30. In the preferred embodiment, the switch 88 is received in a switch slot 48 having a switch slot back and front end 48A, 48B, by means including, as depicted herein, as a switch slide 88A formed generally of a flat element, affixed to the switch 88, of a dimension greater than that of the width of the switch slot 48; the switch 88 is further affixed to linking means comprised for example of at least one switch link pin 89 received through a link member aperture 71 where the said switch link pin 89 is received into a switch pin aperture 89A positioned at the switch slide 88A to thereby facilitate the exertion of slidable force against the linking system 69 to rotatably move the blade member 30.

In the preferred embodiment, shown in the figures, the at least one upper handle member 14 includes at least one upper liner member 21 or upper casing member and the at least one lower handle member 16 includes at least one lower liner member 23 or lower casing member. Other embodiments may not employ the upper or lower liner member 21, 23 or may not employ at least one or both the upper liner member and the lower liner member 21, 23.

Figures 5, 5A:
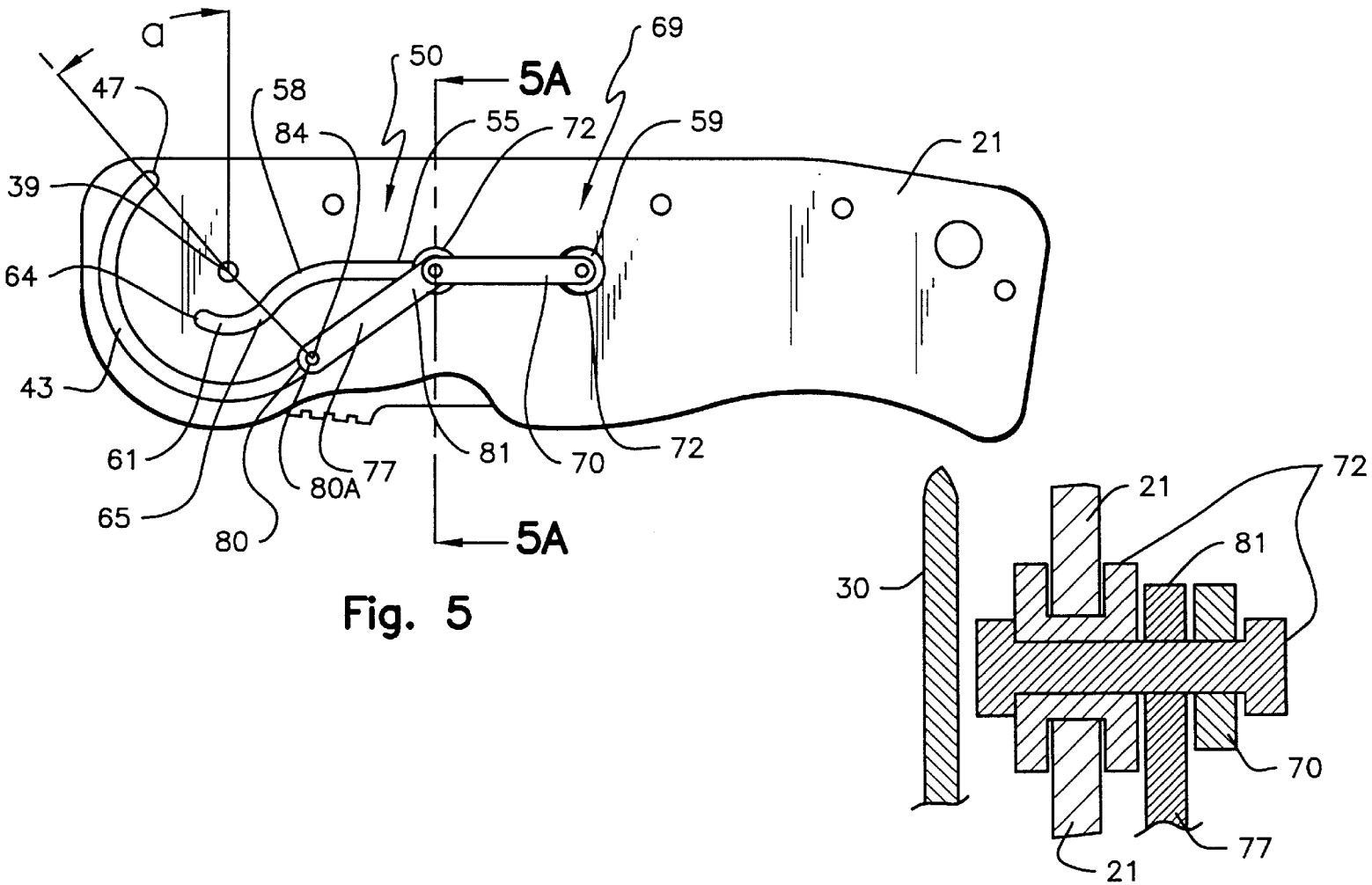
FIG. 5 is a plan view which depicts at least one upper liner member showing the pin slot, actuator slot, link member, elongated member with pin and bushing mechanisms affixing the link member into the actuator slot and the interconnection of the link member and elongated member into the actuator slot and elongated member front end with blade pin member received into the elongated member aperture.
FIG. 5A is a section view from FIG. 5 from actuator slot linear portion back end toward linear portion front end showing the pin and bushing mechanism at the joinder of the link member and the elongated member with the bushing received into the actuator slot at the linear portion. Depicted is the pin and bushing mechanism interconnection of the link member and the elongated member. The blade member is shown.
Figure 6A:
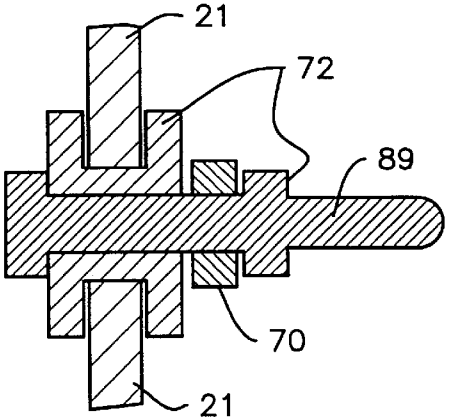
FIG. 6A is a section from FIG. 6 viewing from the linear portion back end toward the linear portion front end. Shown is the interconnection of the pin and bushing mechanism with the link member and the actuator slot. The link member is depicted as is the pin and bushing mechanism switch link pin.
Figure 6:
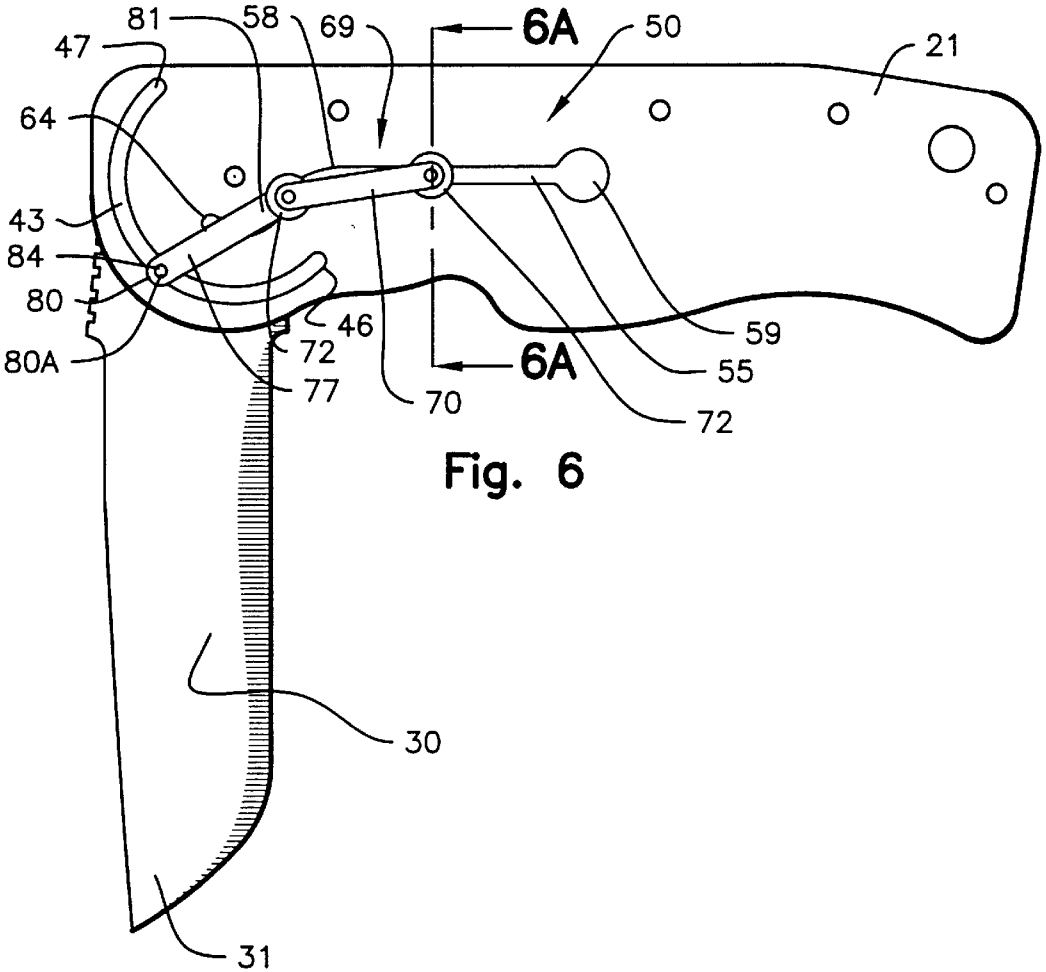
FIG. 6 depicts the view where the blade member is partially opened. Shown is the movement of the link member and elongated member causing the elongated member front end, receiving the blade pin member at the elongated member aperture, to exert rotational force on the blade pin member moving the blade to a partially open position. Also depicted is the linear portion back end.
Figure 7:
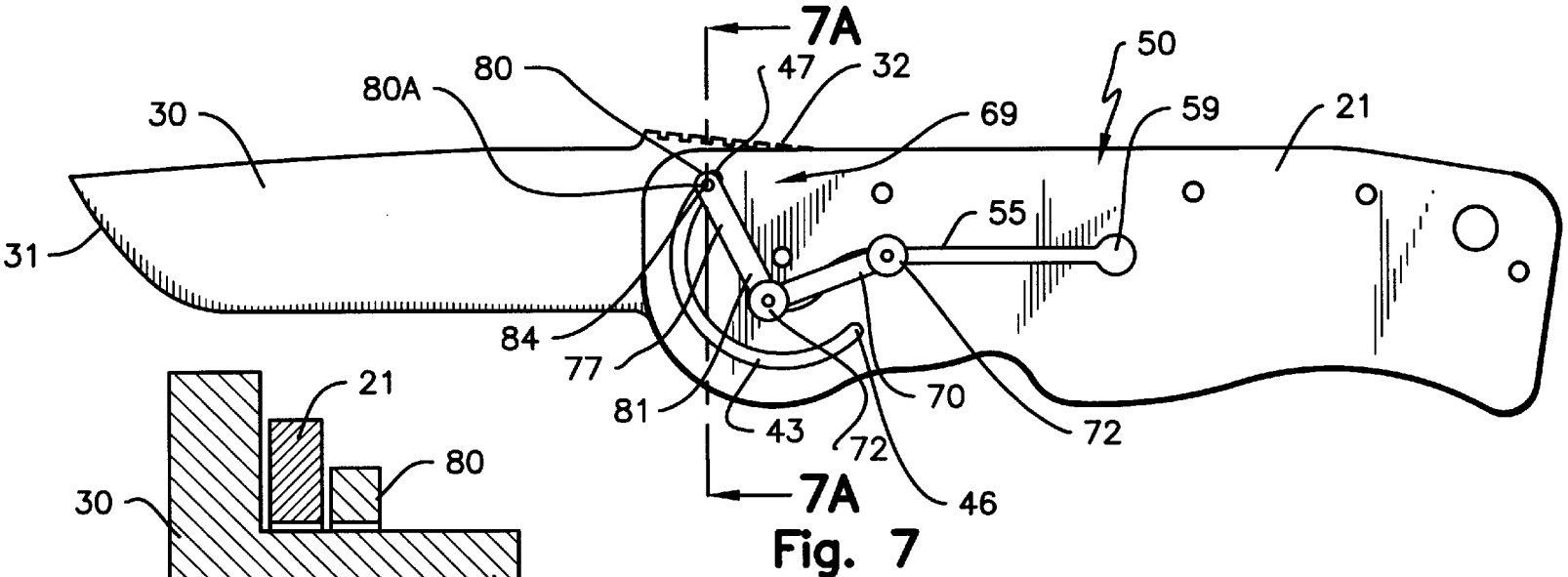
FIG. 7 illustrates the upper liner member, actuator slot with linear portion and linear potion back end, link member and elongated member and pin and bushing mechanism. Shown is the elongated member front end receiving the blade pin member with the blade member in fully open position. Depicted is the travel of the actuator system in moving the interconnected link member and elongated member such that the pin and bushing mechanism interconnecting the link member and the elongated member has moved from the linear portion through the linear portion front end past the arc portion back end into the arc portion and toward the arc portion front end providing the force to rotatably move the blade member to the open position.
Figure 7A:
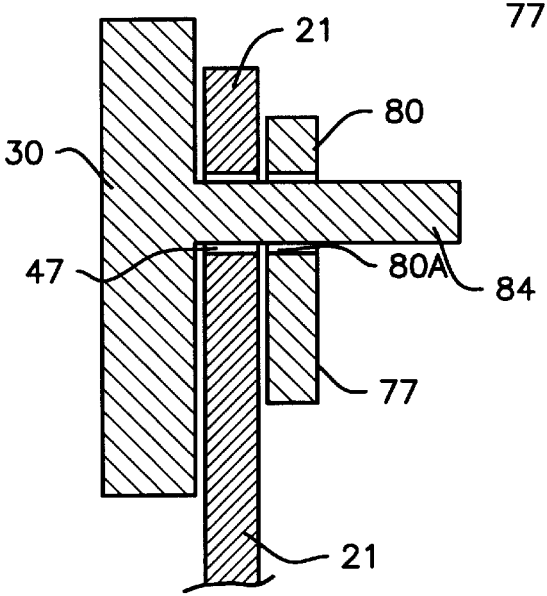
FIG. 7A is a section from FIG. 7 viewing from the pin slot toward the blade member front end. Shown is the blade member, the blade pin member received through the pin slot and received into the elongated member aperture.
Figure 8:
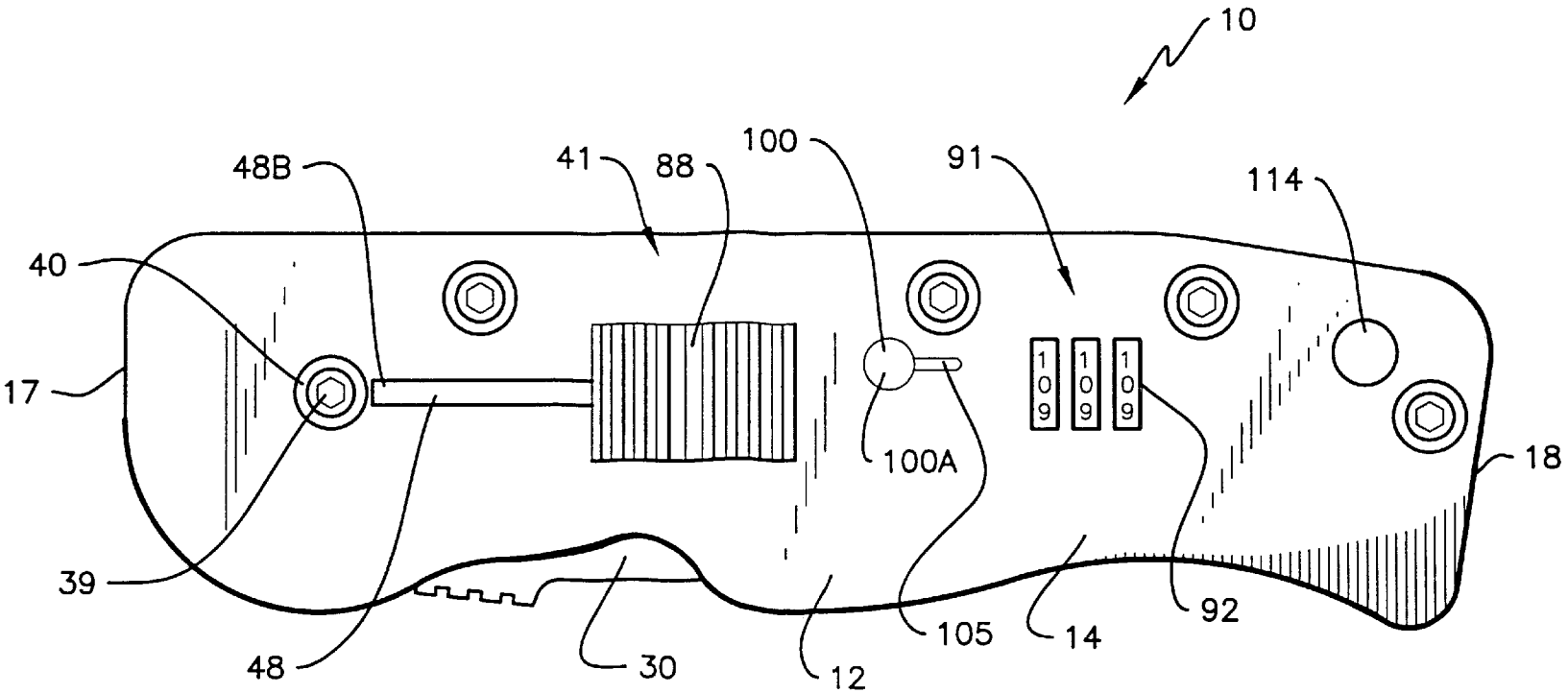
FIG. 8 is a plan view illustrating a securing member 91 showing a catch and catch slot showing the catch in the unsecured position.
Figure 8A:
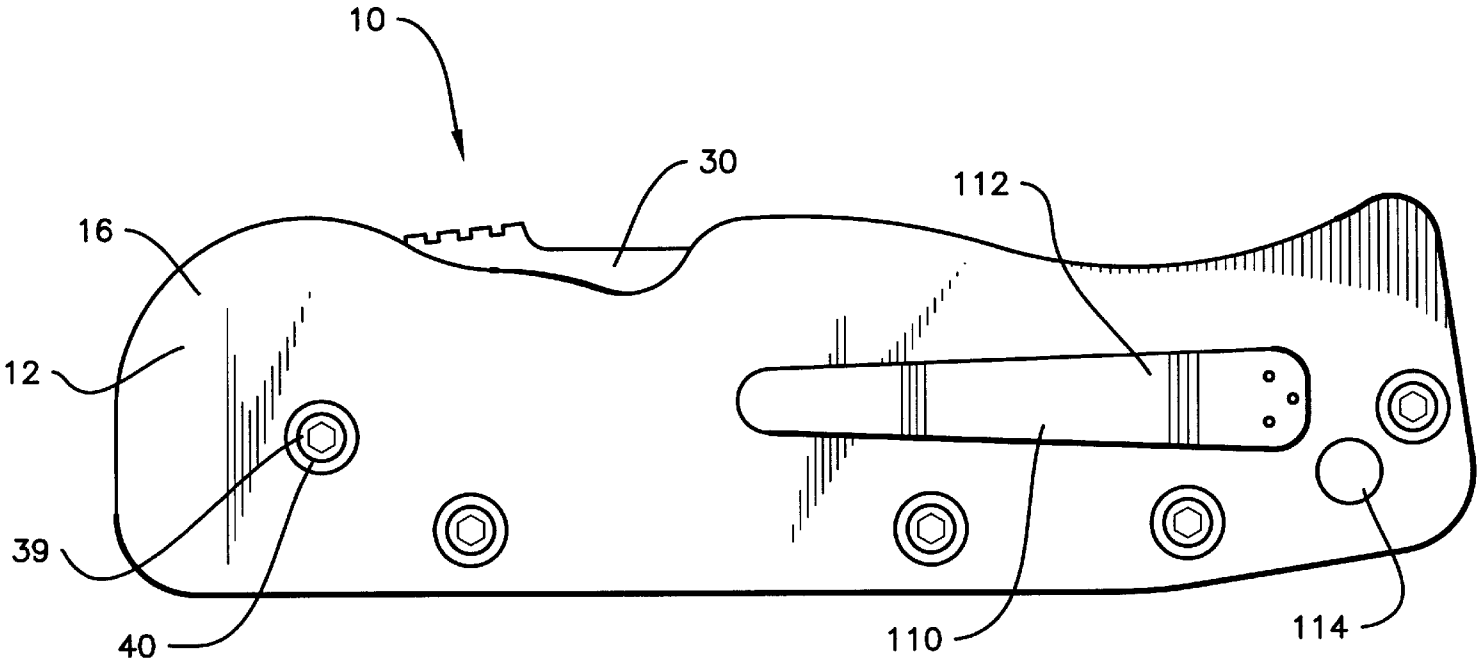
FIG. 8A is a plan view illustrating a lower handle member leverage means with raised or depressed portion 112 and shown here as a belt clip 110 generally formed of spring steel and is affixed by means including screw, brad, rivet or similar affixing means.
Figure 8B:
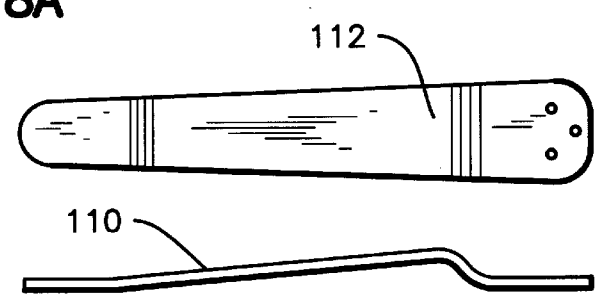
FIG. 8B is a side elevation of leverage means depicted as a belt clip 110.

The folding blade knife 10 may further comprise a pin slot 43, formed within the at least one upper handle member 14 or the upper liner member 21, proximal the handle member front end 17 and arched around the pivotal member 39. The pin slot 43 may have a pin slot front end and a back end 47, 46. In the preferred embodiment, as best shown in FIGS. 4, 4A, 5, 6 and 7, the pin slot 43 may define a half-circle arc with respect to the pivotal member 39, the pivotal member 39 defining a circle center. The pin slot back end 46, the pin slot front end 47, and the pivotal member 39 may be configured in a substantially linear arrangement thereby defining a diameter from the pin slot back end 46, pin slot front end 47, and through the pivotal member 39. Preferably, the substantially linear arrangement of the pin slot back end 46, the pin slot front end 47, and the pivotal member 39 is substantially at a forty-five degree angle 'a', with respect to normal, as shown in FIG. 5.

In alternative embodiments (not shown), the pin slot 43 may have non-half circle configurations. The substantially linear arrangement of the pin slot back end 46, the pin slot front end 47, and the pivotal member 39 may be in a non-forty-five degree relationship with respect to normal. Likewise, the pin slot back end 46, pin slot front end 47, and the pivotal member 39 may be in a non-linear configuration.

The knife 10 may further comprise an actuator slot 50, formed within at least one handle member 12, the at least one upper or lower handle member 14, 16 or the at least one upper or lower liner member 21, 23. In the preferred embodiment an actuator slot 50 is formed within at least one upper liner member 21 extending principally from the handle member front to back end 17, 18. The actuator slot 50 having a linear portion 55 having a linear portion front end and a back end 58, 59, and an arc portion 61 having an arc portion front end and a back end 64, 65. The actuator slot arc portion 61 may be positioned proximal the handle member front end 17 between the pin slot 43 and the pivotal member 39 with said actuator slot linear portion 55 extending a distance distal from the actuator slot arc portion back end 65. As shown in FIGS. 4 through 7, the actuator slot linear portion 55 may extend in a substantially horizontal direction in the same horizontal plane as the pivotal member 39. In other embodiments, the actuator slot linear portion 55 may extend in non-horizontal directions and may be positioned above or below the horizontal plane of the pivotal member 39.

Figure 2A:
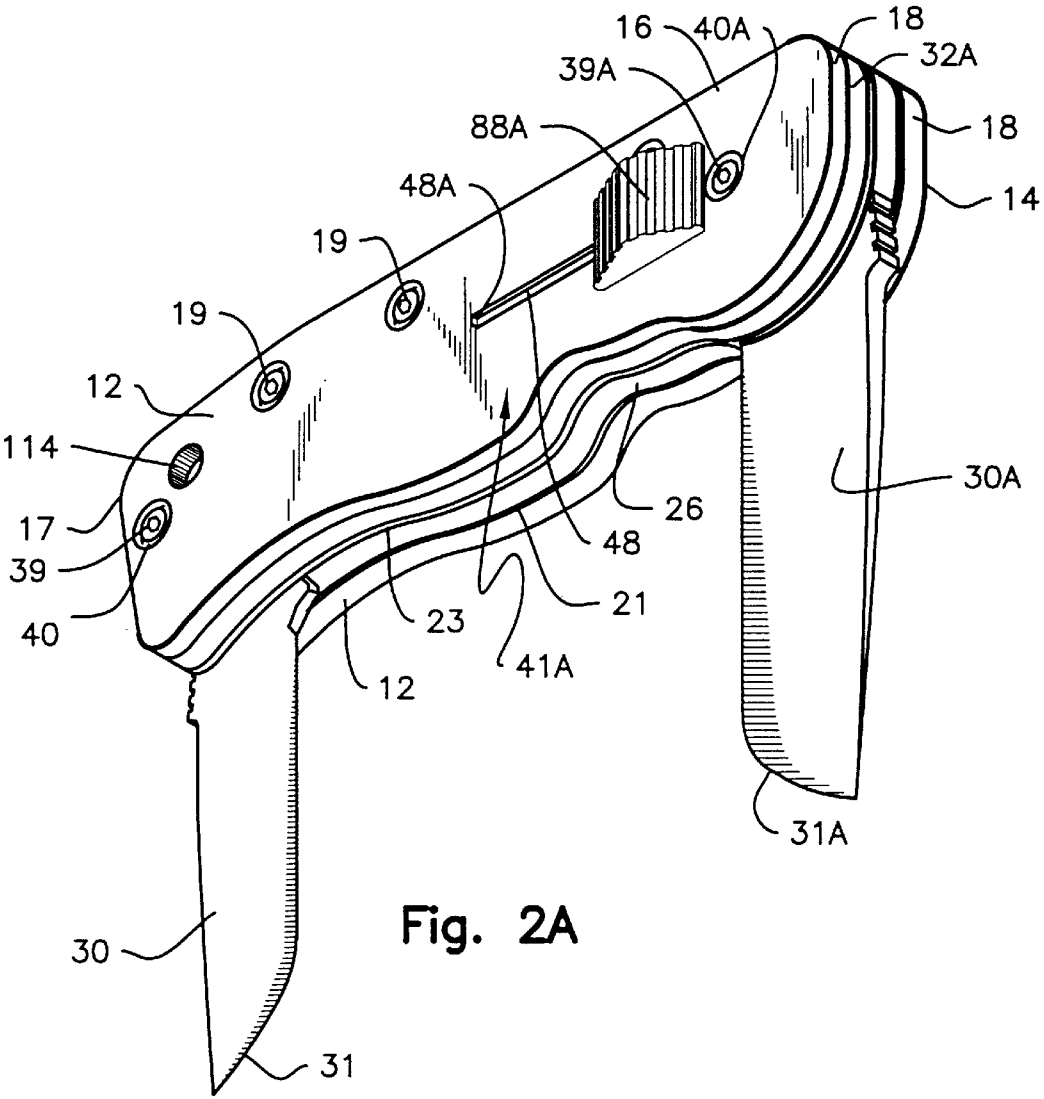
FIG. 2A is a perspective view of a knife constructed in accordance with the present invention where the embodiment is illustrated with multiple blade members and multiple actuator systems. A switch is demonstrated on a lower handle member. A pivotally member and pivotal member aperture is shown at the handle back end and front end.
Figure 3:
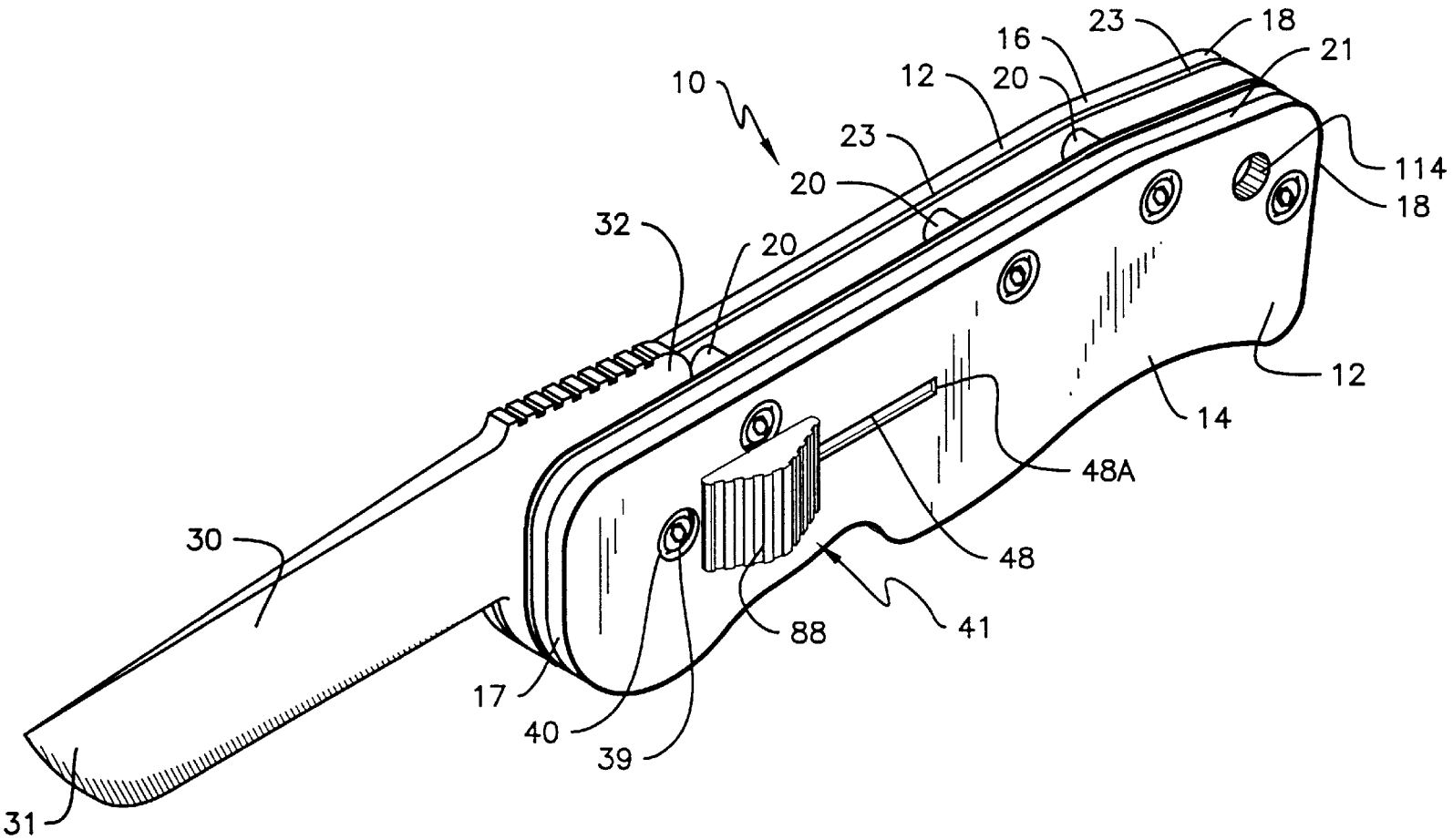
FIG. 3 is a perspective view of a knife constructed in accordance with the present invention where the blade member is fully opened.

It will be appreciated by those of ordinary skill in the art that more than one blade member 30 may be received into the channel 26 with each of the at least one blade members 30 operated by an actuator system 41. Thus elements of an actuator system 41, for actuation of each blade member 30, may be expected to be formed within handle members 12, upper and or lower handle members 14, 16 and upper and or lower liners 21, 23; additionally other elements of an actuator system 41, for each such additional blade members 30 will exist to insure the actuating interconnection of the switch 88 with the blade member 30. FIG. 2A illustrates a knife 10 with multiple blades shown as at least one blade member 30, at least a second blade member 30A and multiple actuator systems 41 with a second actuator system 41A shown. A switch 88 is demonstrated on a lower handle member 16. Pivotal members 39, 39A and pivotal member aperture 40, 40A are shown proximal to the handle back end and front end 18, 17. An embodiment with multiple blade members 30 is composed of at least one blade member 30 actuated by at least one actuator system 41 controlled by at least one switch 88 positioned at an at least one upper handle member 14 with a second blade member 30, denominated here as at least a second blade member 30A received into the channel 26 and actuated by an actuator system 41A controlled by a switch 88A positioned at a handle member 12 and, as demonstrated in FIG. 2A, at least one lower handle member 16. The second blade member 30A may be received into the channel 26, be pivotally affixed proximal the handle back end 18 and be actuated by an actuator system 41A controlled by a switch 88 positioned at an either the at least one upper or lower handle member 14, 16 wherein the switch 88 is proximal the handle back end 18. Alternative embodiments may have actuator systems 41 with switches 88 positioned in many configurations including multiple switches 88 on the upper or lower handle member 14, 16; some switches 88 positioned on the upper handle member 14 with others on the lower handle member 16; switches 88, switch slots 48, pin slots 43, and actuator slots 50 positioned side by side, adjacent, distal and in other configurations such that one or more or multiple blade members 30 may be pivotally fixed proximal the handle front end 17 with one or more or multiple blade members 30 pivotally fixed proximal the handle back end 18. It will be recognized that actuator systems 41, in their entirety including all linking members, bearings, pins and other interconnecting means will be employed for the operation of each blade member 30.

In the preferred embodiment, as shown in FIGS. 1 through 8, the actuator system 41 may comprise at least one link member 70 having a link member front and back end 70A, 70B, slidably mounted within the actuator slot 50 by, but not limited to, pin and bushing mechanisms 72. The pin and bushing mechanism 72 depicted in these illustrations is an example of a bearing and linking means which may be provided by other bearing and linking mechanisms recognized by those of ordinary skill in the art. The actuator system 41 may further comprise at least one elongated member 77, having an elongated member front end and a back end 80, 81. The at least one elongated member back end 81 may be rotatably joined to the at least one link member 70 via the pin and bushing mechanism 72.

The at least one elongated member front end 80 may be joined to a blade pin member 84. The blade pin member 84 may be affixed to the blade member back end 32 and extend through the pin slot 43, such that the blade pin member 84 is positioned proximal the pin slot back end 46 when the blade member 30 is in the closed position and the blade pin member 84 is positioned proximal the pin slot front end 47 when the blade member 30 is in the open position. A switch 88, lever, or the like member may be affixed to the at least one link member 70 to thereby facilitate the exertion of force against the actuator system 41 to slide the link member 70 and elongated member 77 with respect to the upper liner member 21 and actuator slot 50. In the preferred embodiment the pin slot 43 will be concentric with the pivotal member aperture 40. The blade pin member 84, during opening and closing of the blade member 30, will likewise travel concentrical with respect to the pivotal member aperture 40 and, in the preferred embodiment, will have a radius relative to the pivotal member aperture 40 such that the blade pin member 84 is received into and through the pin slot 43 and, in movement in the pin slot 43, will not touch or bear upon any portion of the pin slot 43.

In the preferred embodiment the at least one link member 70 is rotatably and slidably interconnected with the actuator slot 50 via a pin and bushing mechanism 72 at the at least one link member 70 back end 70B with said pin and bushing mechanism 72 switch link pin 89 received by the switch pin aperture 89A. A pin and bushing mechanism 72 at the at least one link member 70 front end 70A rotatably and slidably interconnects with the actuator slot 50 and with the at least one elongated member 77 at the at least one elongated member 77 back end 81. The at least one elongated member 77 is rotatably affixed to the blade pin member 84, which is received through the pin slot 43, at the at least one elongated member 77 front end 80.

In alternative embodiments (not shown), the at least one link members 70 may be joined directly to the blade member back end 32 via means including for example, the blade pin member 84.

In another alternative embodiment (not shown), the pin slot 43 may not be necessary. The at least one link member 70 or the elongated member 77 may be joined to the blade pin member 84 which, in such alternative embodiment, would not extend through a pin slot 43.

To operate, a user may hold the knife 10 in one hand. The user's thumb may push the switch 88, lever, or like member forward towards the handle member front end 17 and thereby open the blade member 30. The user's thumb may pull the switch 88, lever, or like member towards the handle member back end 18 and thereby close the blade member 30.

The folding blade knife 10 may further comprise means, joined to the actuator system 41, to secure the blade member 30 in the closed position. As best shown in FIGS. 8 through 14, the securing means may include, but is not limited to, a securing or locking interrelationship of a switch securing shaft 97 affixed, by affixing means, to the switch 88, a securing member 91, such as a lock 92 having securing member shaft 93, a catch 100 having a catch notch 105 with the catch 100 received through a catch slot 106; the catch 100 may be spring loaded with a catch spring 101; the catch 100 is held in positions of knife unsecured 102, knife secured 103, and adjust lock 104 by means including, for example, engaging or disengaging a notch in the catch 100 with the slot. The locking aspect of the securing member 91 is depicted, for convenience, as a lock 92 with securing member shaft 93 representative of a shaft which is extended when the lock 92 is in the unlocked position and which is retracted when the lock 92 is in the locked position. It will be recognized by those of ordinary skill in lock arts that other locking mechanisms and methods will be the equivalent including but not limited to, for example, pad locks. The catch 100 and catch slot 106, in the preferred embodiment, are intermediate the switch 88 and the securing member 91. Where multiple blade members 30, 30A, are utilized, movement of the switch 88 and catch 100 may be toward the handle front or the handle back 17, 18, depending upon the location of the blade member 30, 30A proximal the handle front or handle back 17, 18.

Figure 9:
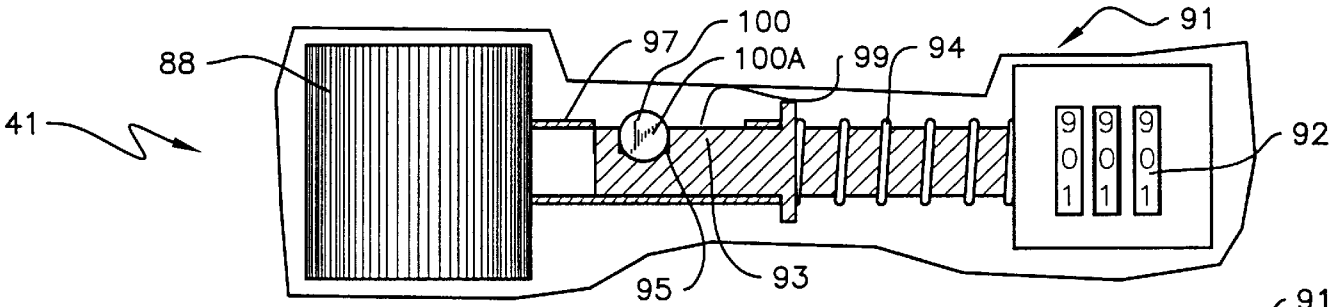
FIG. 9 is a cutaway from FIG. 8 showing an embodiment of a securing member 91 with the securing member shaft spring decompressed and the knife in the unsecured position with the blade member in the closed position. The catch in this illustration is demonstrated in FIG. 12 as the left most position proximal the handle member front end and marked with the section for FIG. 13.
Figure 10:
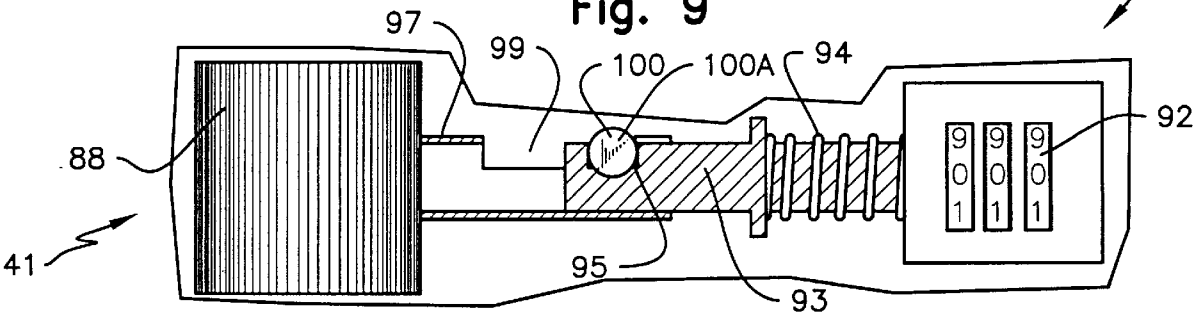
FIG. 10 is a cutaway from FIG. 8 with the securing member shaft spring compressed placing the knife in the secured or locked position with the blade member in the closed position. The catch in this illustration is demonstrated in FIG. 12 as the middle position marked with the section for FIG. 14.
Figure 11:
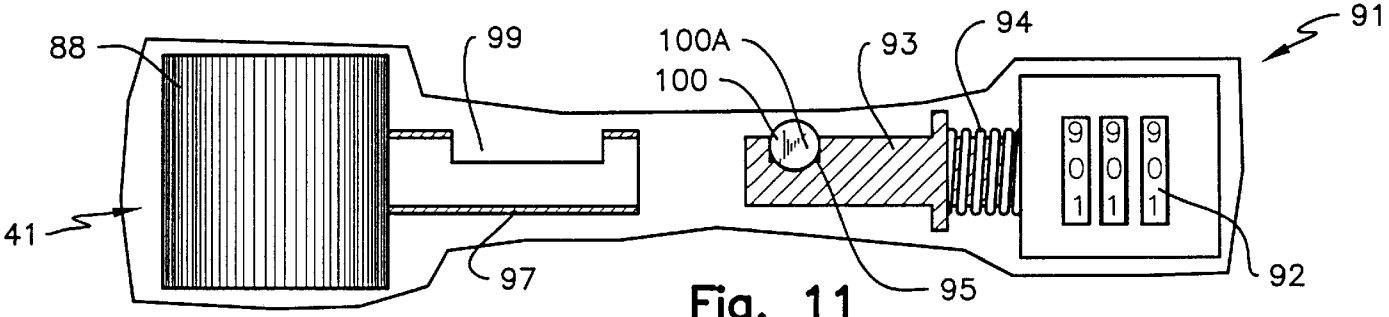
FIG. 11 is a cutaway from FIG. 8 with the securing member shaft spring fully compressed allowing adjustment of the securing member combination lock setting. In this illustration the knife blade member is unsecured and open or partially open. The catch in this illustration is demonstrated in FIG. 12 as the right most position proximal the handle member back end and marked with the section for FIG. 15.
Figures 12, 13, 14, 15:
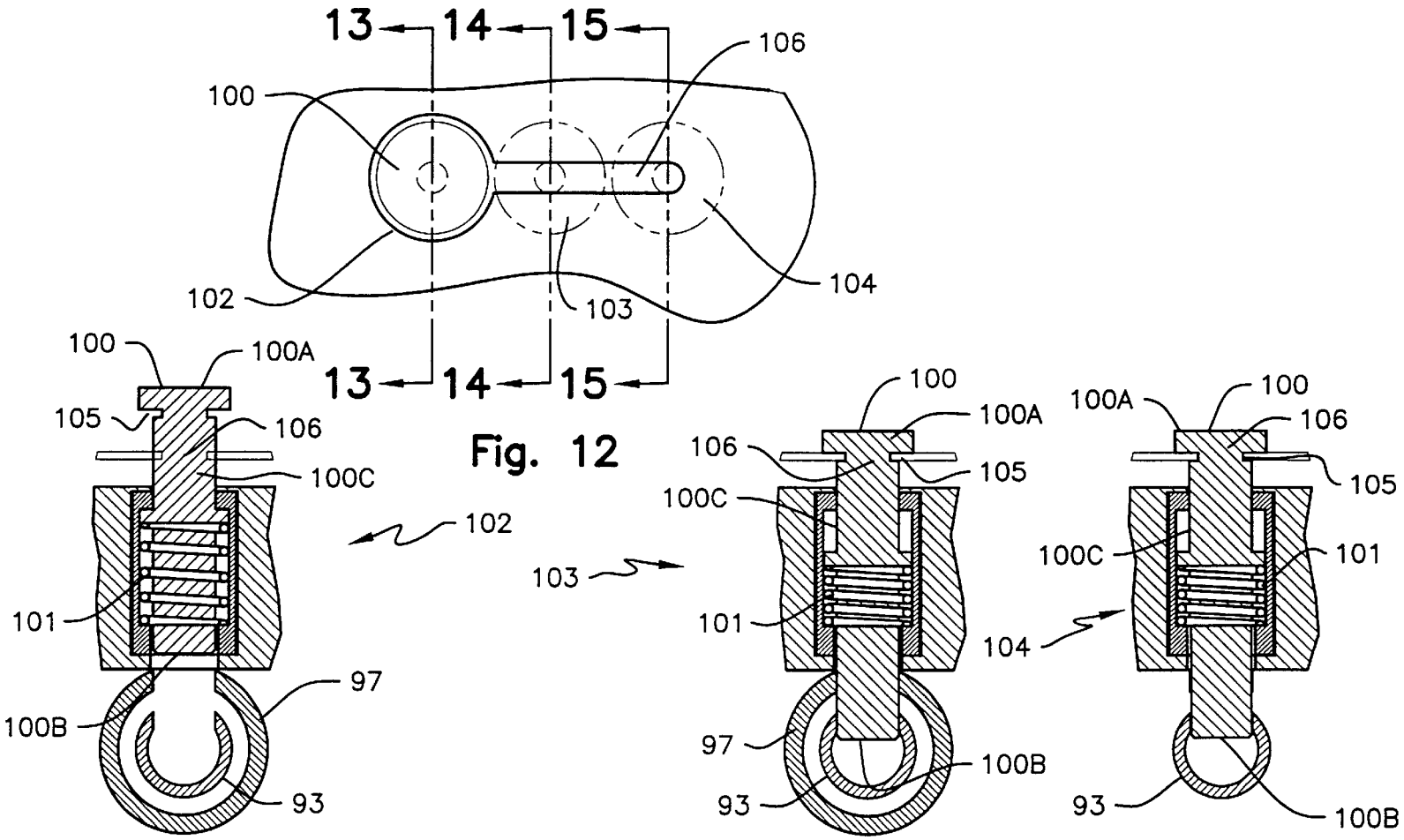
FIG. 12 depicts the catch 100, catch slot 106 and knife unsecured position 102, the knife secured position 103 and the adjust lock position 104. The catch slot 106 may be formed in a handle member 12, upper or lower handle member 14, upper or lower liner member 21, 23 or other structure.
FIG. 13 is a section from FIG. 12 showing an elevation view from handle rear to front end of the catch 100 in the extended and knife unsecured position 102. Depicted is the catch top, bottom and shaft 100A, 100B, 100C, catch notch 105 and catch slot 106. The securing member shaft 93 and switch securing shaft 97 are depicted in the form of cylinders.
FIG. 14 is a section from FIG. 12 showing an elevation view from handle rear to front end of the catch 100 in the depressed and knife secured position 103. The catch spring 101 is depicted partially compressed with the catch shaft 100C depressed such that the catch bottom 100B is received into the securing member shaft notch 95 and switch securing shaft notch 99.
FIG. 15 is a section from FIG. 12 showing an elevation view from handle rear to front end of the catch 100 in the depressed and adjust lock position 104. The catch spring 101 is depicted as compressed with the catch shaft 100C depressed such that the catch bottom 100B is received into the securing member shaft notch 95 enabling the placement of the securing member 91 in a state such that the lock combination may be adjusted.

The securing member 91 example, demonstrated in FIGS 12 through 15, shows a catch slot 106 formed such that an opening larger than a portion of catch 100 exists at a portion of the catch slot 106 with other portions of the catch slot 106 narrowed to receive a notch, denominated catch notch 105, when the catch 100 is depressed and moved into the narrowed portion of the catch slot 106. The catch slot 106 is representative of catch securing means for a shaft or the equivalent, as seen in the catch 100; such catch securing means and catch 100 in combination may be provided by other structures as will be recognized by those of ordinary skill in the art. In FIGS 12 through 15, depression of the catch 100 and movement toward the handle member back end 18 engages the catch notch 105 with the narrowed portion of the catch slot 106 allowing the knife 10 to be secured or locked or allowing the securing member 91 lock combination to be adjusted. Movement of the catch 100 toward the handle member front end 17 unsecured the knife 10 allowing opening of the blade member 30. When released and in its extended position, the catch 100 is disengaged and will allow free movement of the securing member shaft 93 and the switch securing shaft 97. When the switch 88 is moved toward the securing member 91 and the securing member shaft 93, securing member shaft notch 95 and switch securing shaft notch 99 will be superimposed allowing the catch 100, when depressed, to engage both the securing member shaft notch 95 and the switch securing shaft notch 99 as shown in FIG. 9, 10 and 14. It will be recognized that a variety of shaft means may be employed and arrayed such that notches or the equivalent of notches will be aligned such that the depression of a shaft, provided in this example by the catch 100, will permit the shaft to be engaged in both a shaft affixed to the switch 88 as well as the locking or securing shaft affixed to a locking or securing means. The securing means is demonstrated in FIGS. 8 through 15 as a combination lock 92. It is recognized that other locking mechanisms may be employed including, for example, key locks. It will also be recognized that the depiction of the switch securing shaft 97 and securing member shaft 93 is presented in cylinder with notch formation but may also be in other configurations including as an example, without limiting the formation possibilities, side by side flat shafts with notches which may be engaged by shafts, including catches, and controlled via the simple example illustrated here of engagement of shaft notches with a catch 100. The locking or securing of the blade member 30 in the closed position provides for safety and acts as an anti-theft agent. In an alternative embodiment a light means, including for example but not limited to a emitting diode, may be affixed in the handle member 12 to cast light on the locking mechanism, e.g., the combination dials; and or the combination dials may be constructed of a light transmitting plastic receiving light from a light source, e.g., a LED affixed in the handle member 12.

It will be seen that the securing member 91 with associated elements including securing member shaft 93, switch securing shaft 97, catch 100 and catch slot 106 may be affixed, by affixing means, at the handle member 12, upper or lower handle member 14, 16 depending upon the positioning of the switch 88, and additionally may be affixed within the structure of handle members 12 and liners including upper or lower liner members 21, 23; affixing means may include but not be limited to rivet, brad, screw, glue, received into a depression within the handle member 12 or upper or lower handle member 14, 16 and secured by the interconnection of the handle members 12 and by other manner of securing such devices in place. Of course it is seen that in another embodiment the switch 88 and the securing member 91 may not be positioned on or at the same handle member 12. That is, a mechanical linkage may interconnect the switch 88 when the securing member 91 is positioned at a handle member 12 other than the handle member 12 wherein the switch 88 is positioned. The actuator system 41 is described as conveying rotational force against the blade member 30 through a switch 88 interconnected with a link system composed here of a link member 70 and elongated member 77 interconnected by and connected to an actuator slot 50 by pin and bushings 72. The relationship of the switch 88 with the securing member 91 is via the switch securing shaft 97.

In another embodiment, the knife may include leverage means, positioned on one or more of the handle members 12, including the at least one lower and or upper handle member 16, 14, for leverage or as a finger to rest for use in the operation of the knife 10. Attachment means may be provided by a lanyard aperture 114 composed of an aperture receiving, at a handle member 12, a snap, hook, rope, or other item allowing the tying or attachment of the knife 10 to a belt or other such structure.

It is recognized by those of ordinary skill in the art that at least one or multiple securing members 91 may be interconnected with securing means for the securing, in the closed position, of multiple blade members 30.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A folding blade knife comprising:

a) at least one handle member (12) having a channel (26) therein; the handle member (12) having handle member front and back ends (17), (18);

b) at least one blade member (30), having a blade member front end and a back end (31), (32), said blade member back end (32) pivotally mounted with pivotal mounting means proximal said handle member front or back end (17), (18) and within the channel (26); said blade member (30) received into the channel (26);

c) at least one actuator system (41) to transmit force such that the blade member (30) can be rotated from closed to open and back to closed position;

d) pivotal mounting means can be composed of a pivotal member (39), fixed to the at least one handle member (12) and protruding into the channel (26) from the at least one handle member (12) proximal the handle member front or back end (17), (18) where the pivotal member (39) is received through an aperture through the at least one blade member (30) proximal the blade member back end (32); the aperture here denominated pivotal member aperture (40);

e) the at least one actuator system (41) further composed of linkage formed of a slidably movable switch (88) and a linking system (69) to permit transmission of force against a blade pin member (84) affixed to the blade member (30) proximal the blade member back end (32) such that the at least one blade member (30) can be rotated from closed to open and back to closed position;

f ) the linking system further composed of at least one link member (70) having front and back ends (70A), (70B) interconnected with at least one elongated member (77) having front and back ends (80), (81) by pin and bushing mechanisms (72); the at least one handle member (12) having at least one switch slot (48) having switch slot back and front ends (48A), (48B); the switch (88) is received and secured by means into the at least one switch slot (48); the at least one switch slot (48) extends principally from the handle member front end to the handle member back end (17), (18);

g) at least one pin slot (43), formed within the at least one handle member (12) proximal the handle member front or back end (17), (18) and arched around the pivotal member (39); the at least one pin slot (43) having a pin slot front end and a back end (47), (46);

h) at least one actuator slot (50) formed within the at least one handle member (12); the at least one actuator slot

(50) extends principally from the handle member front to back end (17), (18); the at least one actuator slot (50) having a linear portion (55) having a linear portion front end and a back end (58), (59), and an arc portion (61) having an arc portion front end and a back end (64), (65); the actuator slot arc portion (61) is positioned proximal the handle member front or back end (17),(18) between the at least one pin slot (43) and the pivotal member (39) with said actuator slot linear portion (55) extending a distance from the actuator slot arc portion back end (65); the actuator slot linear portion (55) extends in a substantially horizontal direction in the same horizontal plane as the pivotal member (39);

i) the at least one link member (70) slidably mounted within the at least one actuator slot (50) by the pin and bushing mechanisms (72); the pin and bushing mechanisms (72) comprising bearing and linking means; the at least one elongated member back end (81) is rotatably joined to the at least one link member (70) via pin and bushing mechanism (72).

2. The folding blade knife of claim 1 further comprising:

a) the at least one link member (70) is rotatably and slidably interconnected with the actuator slot (50) via the pin and bushing mechanism (72) at the at least one link member (70) back end (70B) and further interconnected at the back end (70B) with the switch (88); a pin and bushing mechanism (72) at the at least one link member (70) front end (70A) rotatably and slidably interconnects with the actuator slot (50) and with the at least one elongated member (77) at the at least one elongated member (77) back end (81); the at least one elongated member (77) rotatably affixed to the blade pin member (84); the blade pin member (84) is received into the pin slot (43) and rotatably secured at the at least one elongated member (77) front end (80);

b) means securing the switch (88) into the switch slot (48) composed of a switch slide (88A) formed generally of a flat element, affixed to the switch (88), of a dimension greater than that of the width of the switch slot (48) and slidably relative to the switch slot (48); the switch (88) is further affixed to linking means comprised of at least one switch link pin (89) integral with the pin and bushing mechanism (72) at the link member (70) back end (70B) where the said switch link pin (89) is received into a switch pin aperture (89A) positioned at the switch slide (88A) to thereby facilitate the exertion of slidable force against the linking system (69) to rotatably move the blade member (30);

c) the blade pin member (84) is positioned proximal the pin slot back end (46) when the at least one blade member (30) is in the closed position and the blade pin member (84) is positioned proximal the pin slot front end (47) when the at least one blade member (30) is in the open position.

3. The folding blade knife of claim 1 further comprising:

(a) at least two handle members (12); the at least two handle members (12) each having handle member front and back ends (17), (18); one of said at least two handle members (12) composed of at least one upper handle member (14); the other of said at least two handle members (12) composed of at least one lower handle member (16); each of said at least one upper and one lower handle members (14), (16) having a handle member front end and a back end (17), (18), the juxtaposition of the at least one upper and one lower handle members (14), (16) defines the channel (26); spacing and securing means position the at least one upper and lower handle members (14), (16) to form the channel (26) including but not limited to spacers (20) and securing screws (19) separating and securing the at least one upper and lower handle members (14), (16).

4. The folding blade knife of claim 1 further comprising:

a) at least two handle members (12); the at least two handle members (12) each having handle member front and back ends (17), (18); one of said at least two handle members (12) composed of at least one upper handle member (14); the other of said at least two handle members (12) composed of at least one lower handle member (16); each of said at least one upper and one lower handle members (14), (16) having a handle member front end and a back end (17), (18), the juxtaposition of the at least one upper and one lower handle members (14), (16) defines the channel (26); spacing and securing means position the at least one upper and lower handle members (14), (16) to form the channel (26) including but not limited to spacers (20) and securing screws (19) separating and securing the at least one upper and lower handle members (14), (16);

b) the linking system (69) further composed of at least one link member (70) having front and back ends (70A), (70B) interconnected with at least one elongated member (77) having front and back ends (80), (81) by pin and bushing mechanisms (72); the at least one handle member (12) having at least one switch slot (48) having switch slot back and front ends (48A), (48B); the switch (88) is received and secured by means into the at least one switch slot (48); the at least one switch slot (48) extends principally from the handle member front end to the handle member back end (17), (18);

c) at least one upper liner member (21) intermediate the channel (26) and the at least one upper handle member (14);

d) pivotal mounting means formed by the pivotal member (39) comprising a pin fixed to and protruding from the at least one handle member (12) proximal the handle member front or back end (17), (18) where the pivotal member (39) is received through the aperture at the at least one blade member (30) proximal the blade member back end (32); the aperture here denominated the pivotal member aperture (40); at least one pin slot (43), formed within the at least one upper liner member (21) proximal the handle member front or back end (17), (18) and arched around the pivotal member (39); the at least one pin slot (43) having a pin slot front end and a back end (47), (46).

5. The folding blade knife of claim 4 further comprising:

a) the at least one pin slot (43) defines a half-circle arc with respect to the pivotal member (39), the pivotal member (39) defining a circle center; the pin slot back end (46), the pin slot front end (47), and the pivotal member (39) configured in a substantially linear arrangement thereby defining a diameter from the pin slot back end (46), the pin slot front end (47), and through the pivotal member (39); the substantially linear arrangement of the pin slot back end (46), the pin slot front end (47), and the pivotal member (39) is substantially at a forty-five degree angle 'a', with respect to normal.

6. The folding blade knife of claim 4 further comprising:

a) the at least one pin slot (43) having a non-half circle configurations; the substantially non-linear arrangement of the pin slot back end (46), the pin slot front end (47), and the pivotal member (39) at a non-forty-five degree relationship with respect to normal; the pin slot back end (46), the pin slot front end (47), and the pivotal member (39) positioned in a non-linear configuration.

7. The folding blade knife of claim 1 further comprising:

a) at least two handle members (12); the at least two handle members (12) each having handle member front and back ends (17), (18); one of said at least two handle members (12) composed of at least one upper handle member (14); the other of said at least two handle members (12) composed of at least one lower handle member (16); each of said at least one upper and one lower handle members (14), (16) having a handle member front end and a back end (17), (18) the juxtaposition of the at least one upper and one lower handle members (14), (16) defines the channel (26); spacing and securing means position the at least one upper and lower handle members (14), (16) to form the channel (26) including but not limited to spacers (20) and securing screws (19) separating and securing the at least one upper and lower handle members (14), (16);

b) the linking system (69) further composed of at least one link member (70) having front and back ends (70A), (70B) interconnected with at least one elongated member (77) having front and back ends (80), (81) by pin and bushing mechanisms (72); the at least one handle member (12) having at least one switch slot (48) having switch slot back and front ends (48A), (48B); the switch (88) is received and secured by means into the at least one switch slot (48); the at least one switch slot (48) extends principally from the handle member front end to the handle member back end (17), (18);

c) at least one lower liner member (23) intermediate the channel (26) and the at least one lower handle member (16);

d) pivotal mounting means formed by the pivotal member (39) comprising a pin fixed to and protruding from the at least one handle member (12) proximal the handle member front or back end (17), (18) where the pivotal member (39) is received through the aperture at the at least one blade member (30) proximal the blade member back end (32); the aperture here denominated pivotal member aperture (40); at least one pin slot (43), formed within the at least one lower liner member (23) proximal the handle member front or back end (17), (18) and arched around the pivotal member (39); the at least one pin slot (43) having a pin slot front end and a back end (47), (46).

8. The folding blade knife of claim 7 further comprising:

a) the at least one pin slot (43) defines a half-circle arc with respect to the pivotal member (39), the pivotal member (39) defining a circle center; the pin slot back end (46), the pin slot front end (47), and the pivotal member (39) configured in a substantially linear arrangement thereby defining a diameter from the pin slot back end (46), the pin slot front end (47), and through the pivotal member (39); the substantially linear arrangement of the pin slot back end (46), the pin slot front end (47), and the pivotal member (39) is substantially at a forty-five degree angle 'a', with respect to normal.

9. The folding blade knife of claim 7 further comprising:

a) the at least one pin slot (43) having a non-half circle configurations; the substantially non-linear arrangement of the pin slot back end (46), the pin slot front end (47), and the pivotal member (39) at a non-forty-five degree relationship with respect to normal; the pin slot back end (46), the pin slot front end (47), and the pivotal member (39) positioned in a non-linear configuration.

10. A folding blade knife comprising:

a) at least two handle members (12); the at least two handle members (12) each having handle member front and back ends (17), (18); one of said two handle members (12) composed of at least one upper handle member; the other of said two handle members (12) composed of at least one lower handle member (16); each of said at least one upper and one lower handle members (14), (16) having a handle member front end and a back end (17), (18), the juxtaposition of the at least one upper and one lower handle members (14), (16) defines a channel (26);

b) at least one blade member (30), having a blade member front end and a back end (31), (32), said blade member back end (32) pivotally mounted with the pivotal mounting means proximal said handle member front end (17), said handle member back end (18) and or both handle member front and back ends (17), (18) and within the channel (26);

c) at least one actuator system (41) to permit transmit force such that the at least one blade member (30) can be rotated from closed to open and back to closed position.

d) spacing and securing means position the at least one upper and lower handle members (14), (16) to form the channel (26) including but not limited to spacers (20) separating the at least one upper and lower handle members (14), (16);

e) pivotal mounting means consists of a pin, named here pivotal member (39), fixed to and protruding from one of the handle members (12) proximal the handle member front and or back end (17), (18) where the pivotal member (39) is received through an aperture at the at least one blade member (30) proximal the blade member back end (32); the aperture here denominated pivotal member aperture (40);

f) the at least one actuator system (41) further composed of linkage formed of a slidably moveable switch (88) and a linking system (69) to permit transmission of force against a blade pin member (84) such that the at least one blade member (30) can be rotated from closed to open and back to closed position;

g) the linking system (69) further composed of at least one link member (70) interconnected with at least one elongated member (77) by pin and bushing mechanisms (72); the at least one upper handle member (14) having at least one switch slot (48) having switch slot back and front ends (48A), (48B); the switch (88) is received and secured by meals into the at least one switch slot (48).

11. The folding blade knife of claim 10 further comprising:

a) means securing the switch (88) into the at least one switch slot (48) composed of a switch slide (88A) formed generally of a flat element, affixed to the switch (88), of a dimension greater than that of the width of the at least one switch slot (48) and slidably relative to the switch slot (48); the switch (88) is further affixed to linking means comprised of at least one switch link pin (89) where the said switch link pin (89) is received into a switch pin aperture (89A) positioned at the switch slide (88A) to thereby facilitate the exertion of slidable force against the linking system (69) to rotatably move the at least one blade member (30);

b) at least one actuator slot (50) formed within an at least one upper liner member (21); the at least one actuator slot (50) having a linear portion (55) having a linear portion front end and a back end (58), (59), and an arc portion (61) having an arc portion front end and a back end (64), (65); at least one pin slot (43), formed within the at least one upper liner member (21) proximal the handle member front or back end (17), (18) and arched around the pivotal member (39); the at least one pin slot (43) having a pin slot front end and a back end (47), (46);

c) the actuator slot arc portion (61) positioned proximal the handle member front end (17) between the at least one pin slot (43) and the pivotal member (39) with said actuator slot linear portion (55) extending a distance from the actuator slot arc portion back end (65); the actuator slot linear portion (55) extends in a substantially horizontal direction in the same horizontal plane as the pivotal member (39).

12. The folding blade knife of claim 11 further comprising:

a) the at least one actuator system (41) comprise the at least one link member (70) slidably mounted within the at least one actuator slot (50) by, but not limited to, pin and bushing mechanisms (72); the pin and bushing mechanisms (72) comprising bearing and linking means; the at least one actuator system (41) further comprises at least one elongated member (77), having an elongated member front end and a back end (80), (81); the at least one elongated member back end (81) is rotatably joined to the at least one links member (70) via pin and bushing mechanism (72);

b) the at least one elongated member front end (80) is joined to a blade pin member (84); the blade pin member (84) is affixed to the at least one blade member back end (32) and extend through the at least one pin slot (43), such that the blade pin member (84) is positioned proximal the pin slot back end (46) when the at least one blade member (30) is in the closed position and the blade pin member (84) is positioned proximal the pin slot front end (47) when the at least one blade member (30) is in the open position;

c) the switch (88), is affixed to the at least one link member (70) to thereby facilitate the exertion of force against the actuator system (41) to slide the at least one link member (70) and the elongated member (77) with respect to the upper liner member (21) and the at least one actuator slot (50);

d) at least one blade member (30) open locking means having a spring function; the blade member (30) open locking means depressed when the blade member (30) is closed; the blade member locking means released when the blade member (30) is open; the blade member back end (32) having a notching means which receives the blade member locking means thereby blocking closing movement of the blade member (30).

13. The folding blade knife of claim 12 further comprising:

a) the at least one blade member open locking means composed of at least one blade member lock (24) formed by a portion of at least one upper or lower liner member (21), (23), positioned to be depressed by the blade member (30) when the blade member (30) is closed and released, by spring function, upon opening of the blade member (30); the blade member lock (24) moved by spring function or other equivalent action to physically block and thereby prevent the closing of the blade member (30); the blade member lock (24) is depressed to allow closing of the blade member (30); notching means composed of at least one back end lock notch (34) formed to receive the blade member lock (24) and mechanically block the blade member (30) from closing.

14. The folding blade knife of claim 13 further comprising:

a) at least a second blade member (30A) having front and back ends (31A), (32A), pivotally affixed proximal the handle member front or back end (17), (18); at least a second actuator system (41A) with at least a second switch (88A) interconnected such that exertion of force at the at least a second switch (88A) will exert a rotational force on the at least a second blade member (30A) such that the at least a second blade member (30A) can be rotated to open and closed positions.

15. The folding blade knife of claim 14 further comprising:

a) at least one securing means, joined to the at least one actuator system (41), to secure the at least one blade member (30) in the closed position.

16. The folding blade knife of claim 15 further comprising:

a) the at least one securing means composed of locking interrelationship of at least one switch securing shaft (97) affixed, by affixing means, to the at least one switch (88); at least one securing member (91) having securing member shaft (93), a catch (100) having a catch notch (105) with the catch (100) received through a catch securing means positioning the catch (100) and securing the blade member (30) and unsecuring the blade member (30).

17. The folding blade knife of claim 16 further comprising:

a) the catch securing means provided by a catch slot (106); the catch (100) is spring loaded with a catch spring (101); the catch (100) is depressed and moved to positions of knife unsecured (102), knife secured (103), and adjust lock (104) by means including, engaging or disengaging a notch in the catch (100) with the catch slot (106); the catch (100) and the catch slot (106) positioned intermediate the switch (88) and a securing member (91);

b) the locking aspect of the securing member (91) is a locking means;

c) the catch (100) formed as a shaft (100C) having a catch top and bottom (100A), (100B); the catch slot (106) formed such that an opening larger than a portion of catch (100) shaft (100C) exists at a portion of the catch slot (106) with other portions of the catch slot (106) narrowed to receive a notch at the catch shaft (100C), denominated catch notch (105), when the catch (100) is depressed and moved into knife secured (103) and adjust lock (104) within the narrowed portion of the catch slot (106).

18. The folding blade knife of claim 17 further comprising:

a) the locking means herein is a lock (92); the securing member shaft (93) is extended when the lock (92) is in the unlocked position and is retracted when the lock (92) is in the locked position;

b) movement of the switch (88) toward the securing member (91) advances the switch securing shaft (97) toward the securing member (91) and toward the securing member shaft (93); the switch securing shaft (97) and the securing member shaft (93) having notch means which, when said switch securing shaft (97) and the securing member shaft (93) notch means are aligned, receives the catch (100) shaft (100C) at the shaft bottom (100B) when the catch (100) is depressed.

19. The folding blade knife of claim 18 further comprising:

a) notch means provided by switch securing shaft notch (99) and securing member shaft notch (95);

b) depression of the catch (100) and movement of the catch (100) toward the securing member (91) engages the catch notch (105) with the narrowed portion of the catch slot (106); movement of the catch (100) most proximal the switch (88) positions the catch (100) in the knife unsecured position (102); movement of the catch (100) most proximal the securing member (91) positions the catch (100) in the adjust lock position (104); movement of the catch (100) intermediate the knife unsecured position (102) and the adjust lock position (104) moves the catch (100) to the knife secured position (103).

20. The folding blade knife of claim 19 further comprising:

a) movement of switch (88) toward the securing member (91) and the securing member shaft (93) superimposes the securing member shaft notch (95) and the switch securing shaft notch (99) wherein the catch (100), when depressed, engage both the securing member shaft notch (95) and the switch securing shaft notch (99);

b) the securing member (91), securing member shaft (93), switch securing shaft securing shaft (97), the catch (100) and catch slot (106) affixed, by affixing means, at the handle member (12) or upper or lower handle member (14), (16) or can be affixed within the structure of handle members (12) and liners including upper or lower liner members (21), (23).

21. The folding blade knife of claim 20 further comprising:

a) a light means affixed in the handle member to cast light on the lock (92).

22. The folding blade knife of claim 21 further comprising:

a) the light means comprised of a light emitting diode.

* * * * *